US006202262B1

(12) United States Patent
Hamburger, III

(10) Patent No.: US 6,202,262 B1
(45) Date of Patent: Mar. 20, 2001

(54) UNIVERSAL STRAP LOCK

(76) Inventor: Howard R. Hamburger, III, 103-03 101st Ave., 3rd Floor, Ozone Park, NY (US) 11416

( * ) Notice: Subject to any disclaimer, the term of this patent is extended or adjusted under 35 U.S.C. 154(b) by 0 days.

(21) Appl. No.: 09/303,415

(22) Filed: May 3, 1999

(51) Int. Cl.[7] ..... A45F 3/14

(52) U.S. Cl. ..... 24/265; 24/265 BC; 224/257; 224/258; 224/910

(58) Field of Search ..... 224/257, 258, 224/910; D11/216, 218; D17/20; D3/327; 84/327, 280, 281; 24/614, 615, 616, 625, 302, 265 R, 265 H, 265 BC, 265 AL

(56) References Cited

U.S. PATENT DOCUMENTS

D. 408,435 * 4/1999 Gettings .
4,148,423 * 4/1979 Schlacher .
4,610,476 * 9/1986 Keiner .
4,858,801 * 8/1989 Sameniego .
4,930,695 * 6/1990 Thompson et al. .
4,944,438 * 7/1990 Gallagher .
5,082,155 * 1/1992 Salvador .
5,165,584 * 11/1992 Meagher et al. .
5,427,291 * 6/1995 Smith .
5,503,315 * 4/1996 Ruzika et al. .
5,810,219 * 9/1998 Rosenfield .
5,868,293 * 2/1999 D'Addario et al. .
5,880,384 * 3/1999 Beck .

* cited by examiner

*Primary Examiner*—James R. Brittain

(57) ABSTRACT

A quick disconnect coupling for adapting any guitar strap having a pair of ends with throughbores to any guitar having a pair of guitar strap-attaching pegs that engage the throughbores in the pair of ends of the guitar strap of the guitar, respectively. The coupling includes a first portion, a second portion, first apparatus, and second apparatus. The first portion engages a first guitar strap-attaching peg of the pair of guitar strap-attaching pegs of the guitar. The second portion is releasably engaged to the first portion and engages the throughbore in a first end of the pair of ends of the guitar strap, with the other throughbore in a second end of the pair of ends of the guitar strap of the guitar engaging with a second guitar strap-attaching peg of the pair of guitar strap-attaching pegs of the guitar. The first apparatus releasably engages the second portion to the first portion. The second apparatus engages the second portion to the first end of the guitar strap of the guitar.

9 Claims, 2 Drawing Sheets

UNIVERSAL STRAP LOCK

BACKGROUND OF THE INVENTION

1. Field of the Invention

The present invention relates to a quick disconnect coupling. More particularly, the present invention relates to a quick disconnect coupling for adapting any guitar strap to any guitar.

2. Description of the Prior Art

Numerous innovations for strap related devices have been provided in the prior art that will be described. Even though these innovations may be suitable for the specific individual purposes to which they address, however, they differ from the present invention in that they do not teach a quick disconnect coupling for adapting any guitar strap to any guitar.

For example, U.S. Pat. No. 5,097,572 to Warrick teaches a parachute canopy strap connecting device that comprises a male strap connector having a locking tang including a locking notch, a female strap connector having a housing including a slot for receiving the tang for insertion to a locking position, and a locking lever having a handle mounted on the housing and including a lock shoulder movable into and out of the slot as the locking lever is moved between extreme lock and unlock positions. A spring is provided to bias the locking lever to lock position, and a cover lever is mounted on the housing for movement between positions covering and uncovering the locking lever handle. A second spring biases the cover lever to covering position, and a blocking pawl is mounted on the housing for movement between a normal biased position, blocking movement of the locking lever from unlock to lock positions, and an unblocking position forced by engagement of a contact surface by the locking tang, upon its insertion to locking position. This enables movement of the locking lever to locking position to move the lock shoulder into the tang slot to lock the male strap connector to the housing.

Another example, U.S. Pat. No. 5,005,269 to Hirsch teaches a spring clip closure member for resiliently fastening onto a button type projection, of the type typically used in suspenders, jeans, and other garments. The spring clip includes an inverted U-shaped resilient wire loop having a bight portion for suspension from the gannet. A pair of opposing leg portions each terminate in inwardly directed feet with downwardly directed fingers. The fingers are resiliently separable but are normally biased toward each other. An encasement member envelopes the feet portions and includes a closed pocket for receiving and enveloping depending finger portions. The finger portions can laterally move within the closed pocket so as to engage and release the button type projection. Lateral apertures are provided in the encasement member through which the feet portions extend during a closure operation.

Still another example, U.S. Pat. No. 4,958,416 to Frishling teaches a comfort clip that is comprised of a base with two arms integrally formed therewith and a latch movably mounted thereon to clamp the shoulder harness strap or lap belt strap at a selected position thereon. When two of such comfort clips are used, one on the shoulder harness strap and one on the lap belt strap a rod is connected therebetween to pull the shoulder harness strap sufficiently down so that it is comfortable on the shoulder of a diminutive user. The ends of the rod are held in place on the comfort clips by the straps and are locked in place by the latch.

Yet another example, U.S. Pat. No. 4,809,410 to Van Riesen teaches end pieces, each having a carrier element for a shoulder strap to be fastened thereto and a crotch strap end piece for attachment to a crotch strap. Each of the end pieces has an attachment element for retention on the lock tongue and the attachment elements have complementary shaped free ends by which the shoulder and crotch strap end pieces can engage and fit together independently of the lock tongue. The lock is assembled by fitting together the attachment elements and then passing the lock tongue through the assembled elements and into the lock case.

Still yet another example, U.S. Pat. No. 4,261,493 to Newman teaches an elongated strap, having metal threads to deter cutting, that includes a non-removable ring at one end and a combination lock secured to the other end, for providing an over the shoulder carrier for skis and poles, and a wrap-around lock for securing skis and poles to an anchor.

Yet still another example, U.S. Pat. No. 3,956,805 to Stroh teaches a clip which fastens to garments. The function of the clip is to preclude the strap or carrying cord from slipping off the shoulder of the user and to prevent theft. The outermost is surface of the clip can be decoratively finished.

It is apparent that numerous innovations for strap related devices have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

Accordingly, AN OBJECT of the present invention is to provide a quick disconnect coupling for adapting any guitar strap to any guitar that avoids the disadvantages of the prior art.

Another object of the present invention is to provide a quick disconnect coupling for adapting any guitar strap to any guitar that is simple and inexpensive to manufacture.

Still another object of the present invention is to provide a quick disconnect coupling for adapting any guitar strap to any guitar that is simple to use.

Briefly stated, yet another object of the present invention is to provide a quick disconnect coupling for adapting any guitar strap having a pair of ends with throughbores to any guitar having a pair of guitar strap-attaching pegs that engage the throughbores in the pair of ends of the guitar strap of the guitar, respectively. The coupling includes a first portion, a second portion, first apparatus, and second apparatus. The first portion engages a first guitar strap-attaching peg of the pair of guitar strap-attaching pegs of the guitar. The second portion is releasably engaged to the first portion and engages the throughbore in a first end of the pair of ends of the guitar strap, with the other throughbore in a second end of the pair of ends of the guitar strap of the guitar engaging with a second guitar strap-attaching peg of the pair of guitar strap-attaching pegs of the guitar. The first apparatus releasably engages the second portion to the first portion. The second apparatus engages the second portion to the first end of the guitar strap of the guitar.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Figure 1:
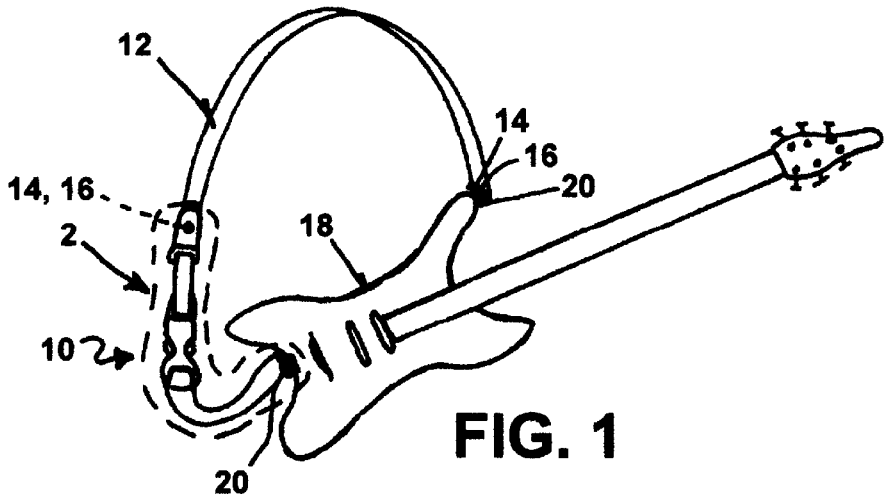
FIG. 1 is a diagrammatic perspective view of the present invention in use.

10 quick disconnect coupling of the present invention
12 guitar strap
14 pair of ends of guitar strap 12
16 throughbores in pair of ends 14 of guitar strap 12
18 guitar
20 pair of guitar strap-attaching pegs of guitar 18
22 first portion for engaging first guitar strap-attaching peg 23 of pair of guitar strap-attaching pegs 20 of guitar 18
23 first guitar strap-attaching peg of pair of guitar strap-attaching pegs 20 of guitar 18
24 second portion for engaging throughbore 16 in first end 26 of pair of ends 14 of guitar strap 12 of guitar 18
26 first end of pair of ends 14 of guitar strap 12 of guitar 18
28 second end of pair of ends 14 of guitar strap 12 of guitar 18
30 second guitar strap-attaching peg of pair of guitar strap-attaching pegs 20 of guitar 18
32 first apparatus for releasably engaging second portion 24 to first portion 22
34 second apparatus for engaging second portion 24 to first end 26 of pair of ends 14 of guitar strap 12 of guitar 18
35 webbed strap of first portion 22
36 first end of webbed strap 35 of first portion 22
38 second end of webbed strap 35 of first portion 22
40 throughbore in first end 36 of webbed strap 35 of first portion 22 for releasably engaging first guitar strap-attaching peg 23 of pair of guitar strap-attaching pegs 20 of guitar 18
42 female part of quick disconnect buckle 44 of first apparatus 32
44 quick disconnect buckle of first apparatus 32
46 ring of female part 42 of quick disconnect buckle 44 of first apparatus 32
47 webbed strap of second portion 24
48 first end of webbed strap 47 of second portion 24
50 second end of webbed strap 47 of second portion 24
52 male part of quick disconnect buckle 44 of first apparatus 32
54 ring of male part 52 of quick disconnect buckle 44 of first apparatus 32
56 length-adjusting ring of second portion 24 for adjusting length of webbed strap 47 of second portion 24
58 guitar strap-engaging member of second apparatus 34 for interchangeably engaging first end 26 of pair of ends 14 of guitar strap 12 of guitar 18
60 base plate of guitar strap-engaging member 58
62 pair of opposing edges of base plate 60 of guitar strap-engaging member 58
64 blindbore in base plate 60 of guitar strap-engaging member 58
66 wall of guitar strap-engaging member 58
68 one opposing edge of pair of opposing edges 62 of base plate 60 of guitar strap-engaging member 58
70 uppermost terminal edge of wall 66 of guitar strap-engaging member 58
72 another opposing edge of pair of opposing edges 62 of base plate 68 of guitar strap-engaging member 58
74 ring of guitar strap-engaging member 58
76 pivot pin of guitar strap-engaging member 58
78 top plate of guitar strap-engaging member 58
80 pair of opposing edges of top plate 78 of guitar strap-engaging member 58
82 throughbore in top plate 78 of guitar strap-engaging member 58
84 thinned area defining throughbore 82 in top plate 78 of guitar strap-engaging member 58
86 one opposing edge of pair of opposing edges 80 of top plate 78 of guitar strap-engaging member 58
88 bifurcation of guitar strap-engaging member 58
90 guitar strap-receiving throughslot of guitar strap-engaging member 58 for receiving first end 26 of pair of ends 14 of guitar strap 12 of guitar 18
92 bolt of guitar strap-engaging member 58
94 shaft of bolt 92 of guitar strap-engaging member 58
96 head of bolt 92 of guitar strap-engaging member 58

DETAILED DESCRIPTION OF THE PREFERRED EMBODIMENT

Referring now to the figures, in which like numerals indicate like parts, and particularly to FIG. 1, which a diagrammatic perspective view of the present invention in use, the quick disconnect coupling of the present invention is shown generally at 10 for adapting any guitar strap 12 having a pair of ends 14 with throughbores 16 to any guitar 18 having a pair of guitar strap-attaching pegs 20 that engage the throughbores 16 in the pair of ends 14 of the guitar strap 12 of the guitar 18, respectively.

The overall configuration of the quick disconnect coupling 10 can best be seen in FIG. 2, which is an enlarged perspective view of the area generally enclosed by the dotted curve identified by ARROW 2 in FIG. 1 of the present invention, and as such, will be discussed with reference thereto.

The quick disconnect coupling 10 comprises a first portion 22 for engaging a first guitar strap-attaching peg 23 of the pair of guitar strap-attaching pegs 20 of the guitar 18.

The quick disconnect coupling 10 further comprises a second portion 24 being releasably engaged to the first portion 22 for engaging the throughbore 16 in a first end 26 of the pair of ends 14 of the guitar strap 12 of the guitar 18, with the other throughbore 16 in a second end 28 of the pair of ends 14 of the guitar strap 12 of the guitar 18 engaging with a second guitar strap-attaching peg 30 of the pair of guitar strap-attaching pegs 20 of the guitar 18.

The quick disconnect coupling 10 further comprises first apparatus 32 for releasably engaging the second portion 24 to the first portion 22.

The quick disconnect coupling 10 further comprises second apparatus 34 for engaging the second portion 24 to the first end 26 of the pair of ends 14 of the guitar strap 12 of the guitar 18.

The first portion 22 comprises a webbed strap 35 that has a first end 36 and a second end 38.

The first end 36 of the webbed strap 35 of the first portion 22 has a throughbore 40 therethrough for releasably engaging the first guitar strap-attaching peg 23 of the pair of guitar strap-attaching pegs 20 of the guitar 18.

The first apparatus 32 includes a female part 42 of a quick disconnect buckle 44 which has a ring 46 formed as one-piece therewith that receives the second end 38 of the webbed strap 35 of the first portion 22 which is then sewed back onto itself so as to secure the female part 42 of the quick disconnect buckle 44 to the second end 38 of the webbed strap 35 of the first portion 22.

The second portion 24 comprises a webbed strap 47 that has a first end 48, a second end 50, and a length.

The first apparatus 32 further includes a male part 52 of the quick disconnect buckle 44 which has a ring 54 formed as one-piece therewith that receives the first end 48 of the webbed strap 47 of the second portion 24 which is then sewed back onto itself so as to secure the male part 52 of the quick disconnect buckle 44 to the first end 48 of the webbed strap 47 of the second portion 24.

The second portion 24 further comprises a length-adjusting ring 56 that is operatively connected to the webbed strap 47 of the second portion 24 for adjusting the length of the webbed strap 47 of the second portion 24.

The second apparatus 34 includes a guitar strap-engaging member 58 that is attached to the second end 50 of the webbed strap 47 of the second portion 24 for interchangeably engaging the first end 26 of the pair of ends 14 of the guitar strap 12 of the guitar 18.

Figure 2:
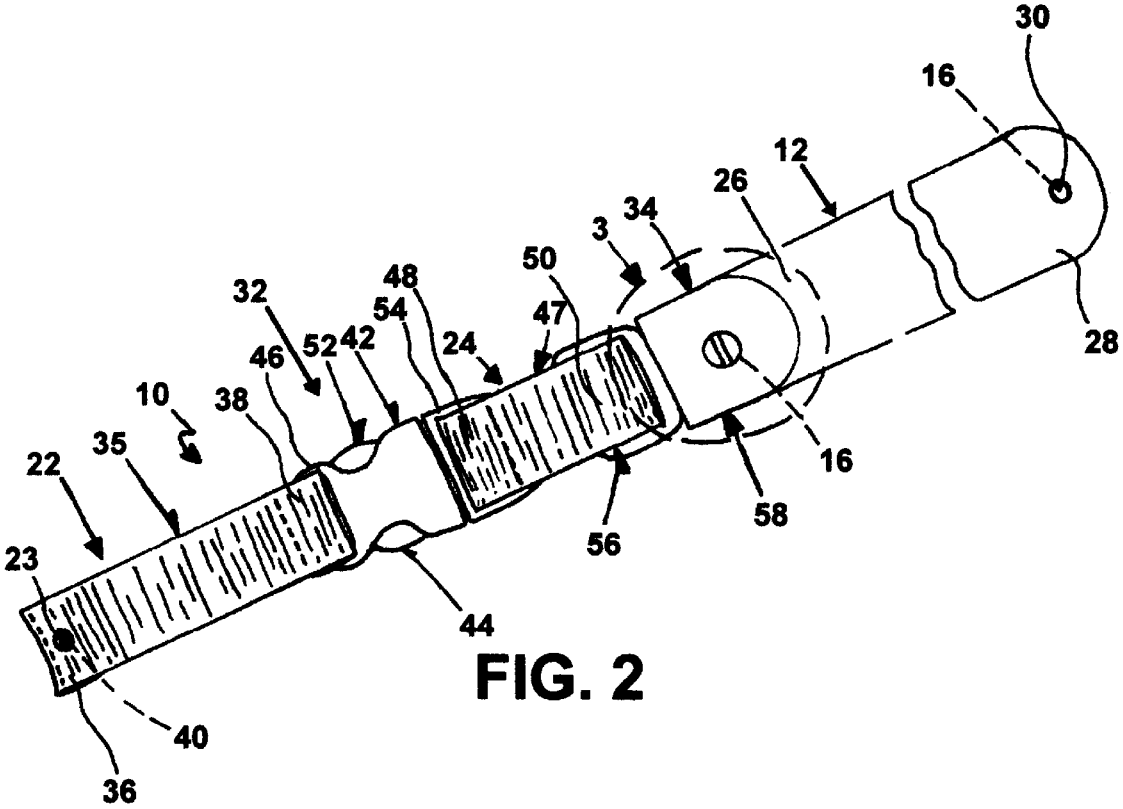
FIG. 2 is an enlarged perspective view of the area generally enclosed by the dotted curve identified by ARROW 2 in FIG. 1 of the present invention.
Figure 3:
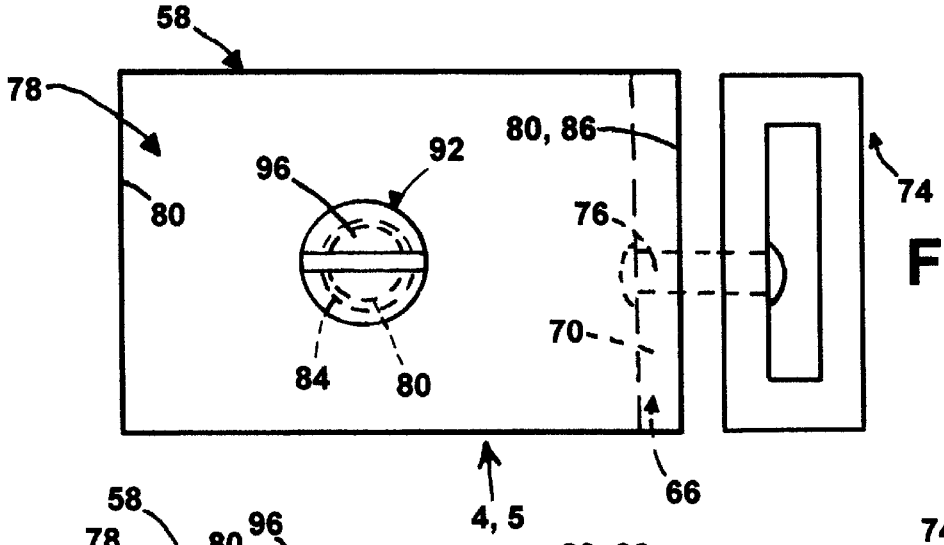
FIG. 3 is an enlarged diagrammatic top plan view of the area generally enclosed by the dotted curve identified by ARROW 3 in FIG. 2 of the guitar strap-engaging member.
Figure 4:
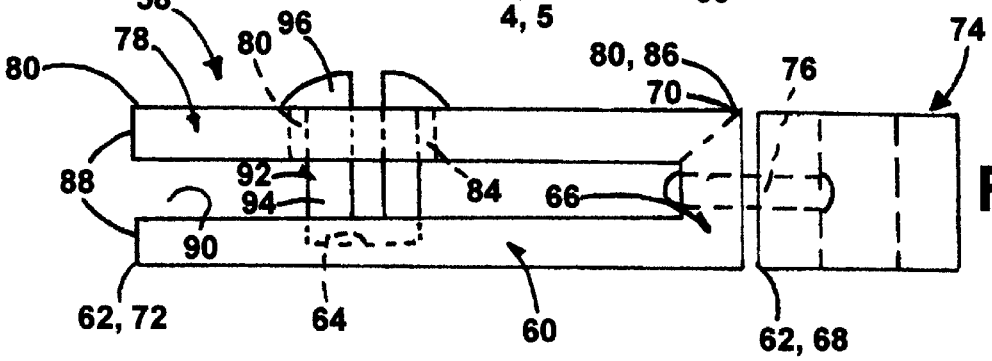
FIG. 4 is a diagrammatic side elevational view taken generally in the direction of ARROW 4 in FIG. 4 of the guitar strap-engaging member in the closed position.
Figure 5:
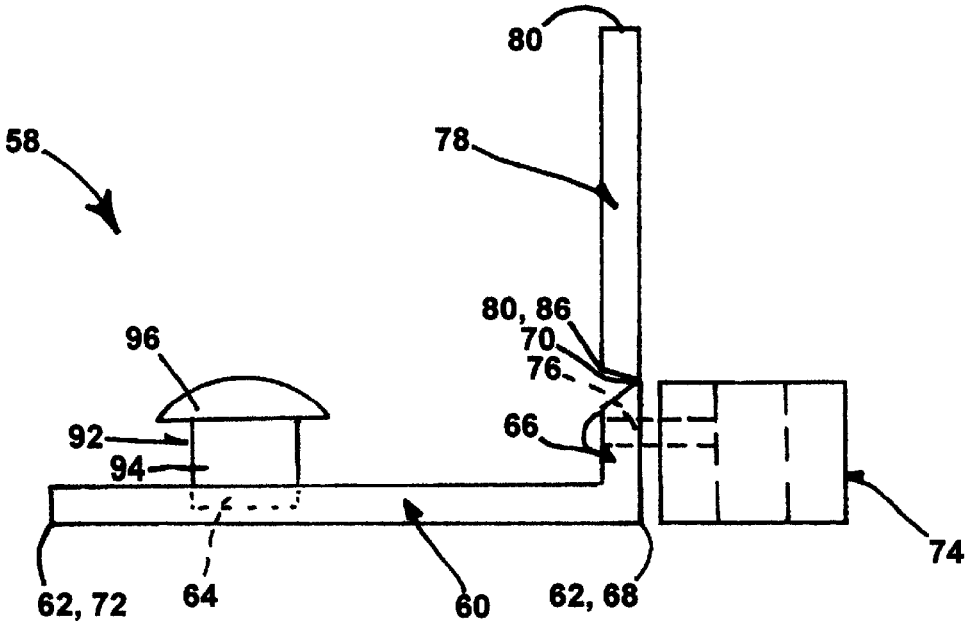
FIG. 5 is a diagrammatic side elevational view taken generally in the direction of ARROW 5 in FIG. 4 of the guitar strap-engaging member in the open position.

The specific configuration of the guitar strap-engaging member 58 can best be seen in FIGS. 3–5, which are, respectively, an enlarged diagrammatic top plan view of the area generally enclosed by the dotted curve identified by ARROW 3 in FIG. 2 of the guitar strap-engaging member, a diagrammatic side elevational view taken generally in the direction of ARROW 4 in FIG. 4 of the guitar strap-engaging member in the closed position, and a diagrammatic side elevational view taken generally in the direction of ARROW 5 in FIG. 4 of the guitar strap-engaging member in the open position, and as such, will be discussed with reference thereto.

The guitar strap-engaging member 58 comprises a base plate 60 that is planar and has a pair of opposing edges 62 that define a length therebetween and a blindbore 64 that is threaded and disposed intermediate the pair of opposing edges 62 of the base plate 60 of the guitar strap-engaging member 58.

The guitar strap-engaging member 58 further comprises a wall 66 that extends vertically upwardly from one opposing edge 68 of the pair of opposing edges 62 of the base plate 60 of the guitar strap-engaging member 58, to a height less than the length of the base plate 60 of the guitar strap-engaging element 58, and forms therewith an L-shaped longitudinal profile, and terminates in an uppermost terminal edge 70.

The uppermost terminal edge 70 of the wall 66 of the guitar strap-engaging member 58 is mitered 45° towards another opposing edge 72 of the pair of opposing edges 62 of the base plate 60 of the guitar strap-engaging member 58.

The guitar strap-engaging member 58 further comprises a ring 74 that is swively mounted, by a pivot pin 76, to the wall 66 of the guitar strap-engaging member 58 and extends in a direction away from the base plate 60 of the guitar strap-engaging member 58, and receives the second end 50 of the webbed strap 47 of the second portion 24 which is then operatively connected to the length-adjusting ring 56 of the second portion 24 so as to adjustably secure the guitar strap-engaging member 58 to the second end 50 of the webbed strap 47 of the second portion 24.

The guitar strap-engaging member 58 further comprises a toy plate 78 that is planar and has a pair of opposing edges 80, a closed position, an open position, and a throughbore 82 that is unthreaded and disposed intermediate the pair of opposing edges 80 of the top plate 78 of the guitar strap-engaging member 58 and defined by a thinned area 84 so as to be resilient, with the thinned area 84 defining the throughbore 82 in the top plate 78 of the guitar strap-engaging member 58 having a diameter.

One opposing edge 86 of the pair of opposing edges 80 of the top plate 78 of the guitar strap-engaging member 58 is hingedly attached to the uppermost terminal edge 70 of the wall 66 of the guitar strap-engaging member 58 and extends in a direction of the base plate 68 of the guitar strap-engaging member 58 when the top plate 78 of the guitar strap-engaging member 58 is in the closed position, a distance equal to the length of the base plate 68 of the guitar strap-engaging member 58 and forms therewith a bifurcation 88 that defines therebetween a guitar strap-receiving throughslot 90 for receiving the first end 26 of the pair of ends 14 of the guitar strap 12 of the guitar 18.

The one opposing edge 86 of the pair of opposing edges 80 of the top plate 78 of the guitar strap-engaging member 58 is mitered 45° so as to from a right angle with the 45° mitered uppermost terminal edge 70 of the wall 66 of the guitar strap-engaging member 58 when the top plate 78 of the guitar strap-engaging member 58 is in the closed position.

The guitar strap-engaging member 58 further comprises a bolt 92 that has a shaft 94 threaded into the blindbore 64 in the base plate 68 of the guitar strap-engaging member 58 and which extends upwardly to a height of the wall 66 of the guitar strap-engaging member 58, where it terminates in a head 96 that is hemispherically-shaped.

When the top plate 78 of the guitar strap-engaging member 58 is in the open position in which it is pivoted away from the base plate 68 of the guitar strap-engaging member 58 and clears the bolt 92 of the guitar strap-engaging member 58, the throughbore 16 in the first end 26 of the pair of ends 14 of the guitar strap 12 of the guitar 18 is engaged over the head 96 of the bolt 92 of the guitar strap-engaging member and swively onto the shaft 94 of the bolt 92 of the guitar strap-engaging member 58, the top plate 78 of the guitar strap-engaging member 58 is then pivoted towards the base plate 68 of the guitar strap-engaging member 58 to achieve the closed position where the throughbore 82 in the top plate 78 of the guitar strap-engaging member 58 engages past the head 96 of the bolt 92 of the guitar strap-engaging member 58 onto the shaft 94 of the bolt 92 of the guitar strap-engaging member 58 and locks the first end 26 of the pair of ends 14 of the guitar strap 12 of the guitar 18 in the guitar strap-receiving throughslot 90 of the guitar strap-engaging member 58, with the first end 26 of the pair of ends 14 of the guitar strap 12 of the guitar 18 swively engaging the shaft 94 of the bolt 92 of the guitar strap-engaging member 58 and the ring 74 of the guitar strap-engaging member 58 swively mounted to the wall 66 of the guitar strap-engaging member 58 both facilitating conforming of the guitar strap 12 of the guitar 18 to a user, with the hemispherical shape of the head 96 of the bolt 92 of the guitar strap-engaging member 58 facilitating insertion into the throughbore 82 in the top plate 78 of the guitar strap-engaging member 58, and with the diameter of the thinned area 84 defining the throughbore 82 in the top plate 78 of the guitar strap-engaging member 58 being slightly larger than that of the head 96 of the bolt 92 of the guitar strap-engaging member 58 facilitating flexing outwardly as the head 96 of the bolt 92 of the guitar strap-engaging member 58 passes through the throughbore 82 in the top plate 78 of the guitar strap-engaging member 58 and then facilitating flexing inwardly when the head 96 of the bolt 92 of the guitar strap-engaging member 58 clears through the throughbore 82 in the top plate 78 of the guitar strap-engaging member 58 so as to lock the top plate 78 of the guitar strap-engaging member 58 in the closed position.

It will be understood that each of the elements described above, or two or more together, may also find a useful application in other types of constructions differing from the types described above.

While the invention has been illustrated and described as embodied in a quick disconnect coupling for adapting any guitar strap to any guitar, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A quick disconnect coupling for adapting any guitar strap having a pair of ends with throughbores to any guitar having a pair of guitar strap-attaching pegs that engage the throughbores in the pair of ends of the guitar strap of the guitar, respectively, said coupling comprising:

a) a first portion for engaging a first guitar strap-attaching peg of a pair of guitar strap-attaching pegs of the guitar; said first portion comprising a webbed strap having:
   i) a first end; and
   ii) a second end;

b) a second portion being releasably engaged to said first portion for engaging a throughbore in a first end of a pair of ends of a guitar strap, with the other throughbore in a second end of the pair of ends of the guitar strap of the guitar engaging with a second guitar strap-attaching peg of the pair of guitar strap-attaching pegs of the guitar; said second portion comprising a webbed strap having:
   i) a first end:
   ii) a second end, and
   iii) a length;

c) first means for releasably engaging said second portion to said first portion; said first means including a female part of a quick disconnect buckle having a ring formed as one-piece therewith receiving said second end of said webbed strap of said first portion being then sewed back unto itself so as to secure said female part of said quick disconnect buckle to said second end of said webbed strap of said first portion; and d) second means for engaging said second portion to the first end of the pair of ends of the guitar strap of the guitar; said second means including a guitar strap-engaging member attached to said second end of said webbed strap of said second portion for interchangeably engaging the first end of the pair of ends of the guitar strap of the guitar; said guitar strap-engaging member comprising:
   i) a base plate being planar, and having:
      A) a pair of opposing edges defining a length therebetween; and
      B) a blindbore being threaded and disposed intermediate said pair of opposing edges of said base plate of said guitar strap-engaging member;
      C) a length; and
   ii) a wall extending vertically upwardly from one opposing edge of said pair of opposing edges of said base plate of said guitar strap-engaging member, to a height less than said length of said base plate of said guitar strap-engaging member, and forming therewith an L-shaped longitudinal profile, and terminating in an uppermost terminal edge; said uppermost terminal edge of said wall of said guitar strap-engaging member being mitered 45 degrees towards the other opposing edge of said pair of opposing edges of said base plate of said guitar strap-engaging member.

2. The coupling as defined in claim 1, wherein said first end of said webbed strap of said first portion has a throughbore therethrough for releasably engaging the first guitar strap-attaching peg of the pair of guitar strap-attaching pegs of the guitar.

3. The coupling as defined in claim 1, wherein said first means further includes a male part of said quick disconnect buckle which has a ring formed as one-piece therewith that receives said first end of said webbed strap of said second portion which is then sewed back onto itself so as to secure said male part of said quick disconnect buckle to said first end of said webbed strap of said second portion.

4. The coupling as defined in claim 1, wherein said second portion further comprises a length-adjusting ring that is operatively connected to said webbed strap of said second portion for adjusting said length of said webbed strap of said second portion.

5. The coupling as defined in claim 1, wherein said guitar strap-engaging member further comprises a ring that is swively mounted, by a pivot pin, to said wall of said guitar strap-engaging member and extends in a direction away from said base plate of said guitar strap-engaging member, and receives said second end of said webbed strap of said second portion which is then operatively connected to said length-adjusting ring of said second portion so as to adjustably secure said guitar strap-engaging member to said second end of said webbed strap of said second portion.

6. The coupling as defined in claim 5, wherein said guitar strap-engaging member further comprises a top plate that is planar, and has:

a) a pair of opposing edges;

b) a closed position;

c) an open position; and d) a throughbore that is unthreaded and disposed intermediate said pair of opposing edges of said top plate of said guitar strap-engaging member and defined by a thinned area so as to be resilient, with said thinned area defining said throughbore in said top plate of said guitar strap-engaging member having a diameter.

7. The coupling as defined in claim 6, wherein one opposing edge of said pair of opposing edges of said top plate of said guitar strap-engaging member is hingedly attached to said uppermost terminal edge of said wall of said guitar strap-engaging member and extends in a direction of said base plate of said guitar strap-engaging member when said top plate of said guitar strap-engaging member is in said closed position, a distance equal to said length of said base plate of said guitar strap-engaging member and forms therewith a bifurcation that defines therebetween a guitar strap-receiving throughslot for receiving the first end of the pair of ends of the guitar strap of the guitar.

8. The coupling as defined in claim 7, wherein said one opposing edge of said pair of opposing edges of said top plate of said guitar strap-engaging member is mitered 45° so as to from a right angle with said 45° mitered uppermost terminal edge of said wall of said guitar strap-engaging member when said top plate of said guitar strap-engaging member is in said closed position.

9. The coupling as defined in claim 7, wherein said guitar strap-engaging member further comprises a bolt that has a shaft threaded into said blindbore in said base plate of said guitar strap-engaging member and which extends upwardly to a height of said wall of said guitar strap-engaging member, where it terminates in a head that is hemispherically-shaped, and when said top plate of said guitar strap-engaging member is in said open position in which it is pivoted away from said base plate of said guitar strap-engaging member and clears said bolt of said guitar strap-engaging member, the throughbore in the first end of the pair of ends of the guitar strap of the guitar is engaged over said head of said bolt of said guitar strap-engaging member and swively onto said shaft of said bolt of said guitar strap-engaging member, said top plate of said guitar strap-engaging member is then pivoted towards said base plate of said guitar strap-engaging member to achieve said closed position where said throughbore in said top plate of said guitar strap-engaging member engages past said head of said bolt of said guitar strap-engaging member onto said shaft of said bolt of said guitar strap-engaging member and locks the first end of the pair of ends of the guitar strap of the guitar in said guitar strap-receiving throughslot of said guitar strap-engaging member, with the first end of the pair of ends of the guitar strap of the guitar swively engaging said shaft of said bolt of said guitar strap-engaging member and said ring of said guitar strap-engaging member swively mounted to said wall of said guitar strap-engaging member both facilitating conforming of the guitar strap of the guitar to a user, with said hemispherical shape of said head of said bolt of said guitar strap-engaging member facilitating insertion into said throughbore in said top plate of said guitar strap-engaging member, and with said diameter of said thinned area defining said throughbore in said top plate of said guitar strap-engaging member being slightly larger than that of said head of said bolt of said guitar strap-engaging member facilitating flexing outwardly as said head of said bolt of said guitar strap-engaging member passes through said throughbore in said top plate of said guitar strap-engaging member and then facilitating flexing inwardly when said head of said bolt of said guitar strap-engaging member clears through said throughbore in said top plate of said guitar strap-engaging member so as to lock said top plate of said guitar strap-engaging member in said closed position.

* * * * *